US012172856B2

(12) United States Patent
Hege et al.

(10) Patent No.: US 12,172,856 B2
(45) Date of Patent: Dec. 24, 2024

(54) CONVEYOR HAVING ADJUSTABLE NIP

(71) Applicant: A. G. Stacker Inc., Weyers Cave, VA (US)

(72) Inventors: Dalton Hege, Weyers Cave, VA (US); Eric Stempihar, Rockingham, VA (US); Joseph Wunder, Lexington, VA (US); Randall Donn Senger, Mount Sidney, VA (US)

(73) Assignee: A.G. STACKER INC., Weyers Cave, VA (US)

( * ) Notice: Subject to any disclaimer, the term of this patent is extended or adjusted under 35 U.S.C. 154(b) by 160 days.

(21) Appl. No.: 17/878,461

(22) Filed: Aug. 1, 2022

(65) Prior Publication Data

US 2023/0038400 A1 Feb. 9, 2023

Related U.S. Application Data

(60) Provisional application No. 63/229,137, filed on Aug. 4, 2021.

(51) Int. Cl.
*B65H 5/02* (2006.01)
*B65H 29/12* (2006.01)

(52) U.S. Cl.
CPC ... *B65H 29/12* (2013.01); *B65H 2301/44316* (2013.01); *B65H 2404/2615* (2013.01)

(58) Field of Classification Search
CPC ..... B65H 2404/253; B65H 2404/2532; B65H 2404/254; B65H 2404/2613; B65H 2404/2615; B65H 2404/262; B65H 2404/261; B65H 2404/265; B65H 2404/2693; B65H 5/021; B65H 5/023; B65H 5/025; B65H 5/026; B65H 29/12; B65H 29/125; B65H 29/14; B65H 29/16; B65H 2701/1764; B65H 2301/44316
See application file for complete search history.

(56) References Cited

U.S. PATENT DOCUMENTS

| | | | |
|---|---|---|---|
| 2,467,423 | A | 4/1949 | Bruker |
| 4,189,965 | A | 2/1980 | Kollann |
| 4,385,537 | A | 5/1983 | Wolf |
| 7,052,009 | B2 | 5/2006 | Roth |

(Continued)

FOREIGN PATENT DOCUMENTS

EP 3456668 A1 * 3/2019 ..... B65H 5/023

*Primary Examiner* — Luis A Gonzalez
(74) *Attorney, Agent, or Firm* — J-TEK LAW PLLC; Jeffrey D. Tekanic; Scott T. Wakeman

(57) ABSTRACT

A conveyor includes a frame, a carriage supported by the frame for sliding movement in a longitudinal direction, a lower conveyor deck supported by the frame and an upper deck. The lower deck has a plurality of contact elements, which may be wheels, for supporting sheets of material moving through the conveyor. The upper deck includes a rear portion having a plurality of longitudinally extending transversely spaced first belts each supported by a plurality of first pulleys and a front portion including a plurality of longitudinally extending transversely spaced second belts each supported a plurality of second pulleys. The plurality of second pulleys includes a first second pulley and a second second pulley that are supported by the carriage for movement with the carriage relative to the frame.

18 Claims, 9 Drawing Sheets

(56) References Cited

U.S. PATENT DOCUMENTS

| | | | | |
|---|---|---|---|---|
| 8,322,719 | B1 | 12/2012 | Roth | |
| 9,771,227 | B2 | 9/2017 | Allen, Jr. et al. | |
| 2004/0245071 | A1 | 12/2004 | Giffin | |
| 2006/0263195 | A1* | 11/2006 | Furthmueller | B65H 31/18 414/793.5 |
| 2011/0285080 | A1 | 11/2011 | Gendreau et al. | |
| 2012/0053035 | A1* | 3/2012 | Diehr | B65H 29/12 271/10.09 |
| 2013/0074457 | A1* | 3/2013 | Brown | B65B 11/00 53/580 |
| 2018/0105382 | A1* | 4/2018 | Allen, Jr. | B65H 29/14 |
| 2023/0264917 | A1* | 8/2023 | Favre | B31B 50/042 271/207 |

* cited by examiner

CONVEYOR HAVING ADJUSTABLE NIP

CROSS-REFERENCE TO RELATED APPLICATIONS

The present application claims the benefit of U.S. Provisional Patent Application No. 63/229,137, filed Aug. 4, 2021, the entire contents of which are hereby incorporated by reference.

TECHNOLOGICAL FIELD

The present invention is directed to a conveyor having an adjustable entrance nip, and more specifically, to a conveyor having an upper deck and a lower deck wherein a portion of the upper deck is shiftable to adjust the entrance nip.

BACKGROUND

A rotary die cut machine is a device for producing sheets of material, corrugated paperboard, for example, that are sometimes referred to as "blanks" or "boards." The rotary die cut machine includes a pair of counterrotating drums that cut the sheets from a web of corrugated material and emit the sheets in a downstream direction where further processing equipment receives the sheets.

A layboy or other type of transfer conveyor is generally placed downstream of the rotary die cut machine to receive the sheets and guide them toward a further piece of downstream processing equipment such as a stacker. For various reasons, including the fact that the transfer conveyor may operate a different speed than the rotary die cut machine, it is generally desirable to set the distance between the exit nip of the rotary die cut machine and the entrance nip of the transfer conveyor based on the length of the sheet being processed—to a distance approximately equal to the length of the sheet, for example. This may prevent the sheet from being engaged by two nips for more than a brief time, which engagement could result in either the sheet being pulled from the rotary die cut machine by the transfer conveyor (if the transfer conveyor is running faster than the rotary die cut machine) or bend or otherwise damage the sheet from (if the transfer conveyor is running slower than the rotary die cut machine).

Different devices and methods are known for adjusting this distance. One such device and method are disclosed in U.S. Pat. No. 8,322,719 to Roth, which is incorporated herein by reference. Another device and method are disclosed in U.S. Pat. No. 9,771,227 to Allen, Jr. which is also incorporated herein by reference.

SUMMARY

The present application discloses an improved device and method of adjusting the distance between the exit nip of a first device such as a rotary die cut machine and the entry nip of a downstream processing device such as a transfer conveyor. A first aspect of the disclosure comprises a conveyor configured to transport sheets in a longitudinal direction along a transport path from an input end to a discharge end. The conveyor includes a frame, a carriage supported by the frame for sliding movement in the longitudinal direction, a lower conveyor deck and an upper conveyor deck. The lower conveyor deck is supported by the frame and includes a plurality of contact elements each having a contact surface movable around a first closed path from a first contact region to a first non-contact region, and the first contact regions lie in a first plane or are bounded by the first plane. The upper deck includes a rear portion having a plurality of longitudinally extending transversely spaced first belts each supported by a plurality of first pulleys and a front portion having a plurality of longitudinally extending transversely spaced second belts each supported by a plurality of second pulleys. The plurality of second pulleys includes a first second pulley and a second second pulley, and the first second pulley and the second second pulley are supported by the carriage for movement with the carriage relative to the frame.

DETAILED DESCRIPTION

Figure 1:
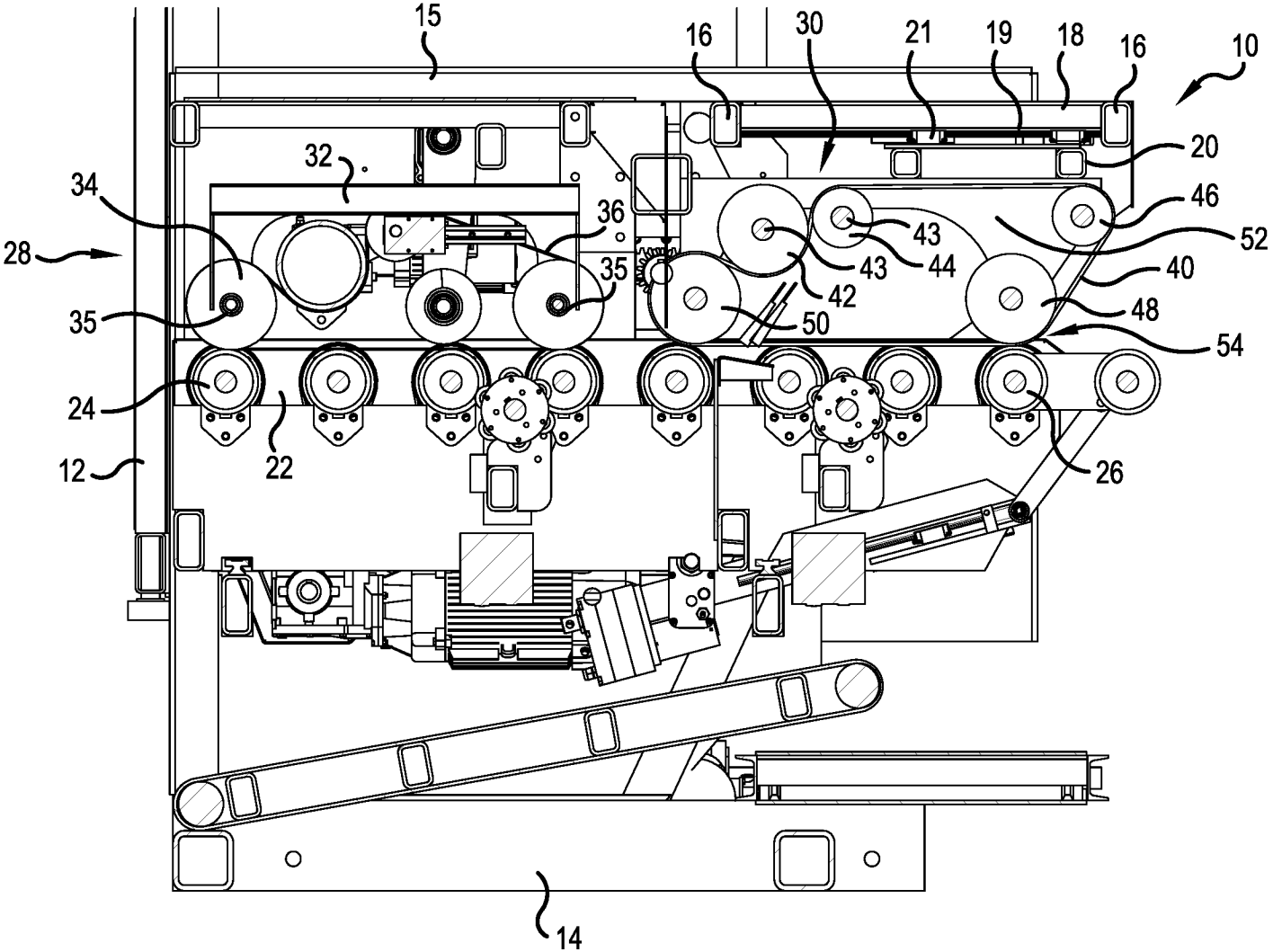
FIG. 1 is a sectional side elevational view of a transfer conveyor according to an embodiment of the present disclosure with a carriage located at a first, forward, location.

Referring now to the drawings, wherein the showings are for purposes of illustrating embodiments of the invention only and not for the purpose of limiting same, FIG. 1 shows a transfer conveyor 10 having a frame 12 including a base portion 14, a plurality of upper longitudinal support members 15 supporting a pair of transverse upper support members 16 and a plurality of rails 18 extending longitudinally between the transverse upper support members 16. A carriage 20 including slide bearings 21 is slidably supported by bearing surfaces 19 of the rails 18 for longitudinal movement between front and rear positions relative to the upper longitudinal support members 16.

The frame 12 supports a lower deck 22 comprising a plurality of wheels 24 (contact elements). Upper or contact portions of the wheels 24 lie in a first plane and form a support surface for sheets of material moving through the transfer conveyor 10. The first plane defines the lower boundary of a sheet transport path through the conveyor section 10. The first wheel downstream from the upstream-most wheel is a nip wheel 26. Instead of wheels, contact elements in the form of belts supported by pulleys (not illustrated) can be used to form the support surface of the lower deck 22. The transfer conveyor 10 also includes an upper deck 28 that has an upstream portion 30 supported by the carriage 20 and a downstream portion 32.

The downstream portion 32 of the upper deck 28 includes a plurality of pulleys 34 supporting a plurality of downstream belts 36 (first belts) arranged transversely across the transfer conveyor 10. These pulley 34 and belts 36 are mounted on shafts 35 that are fixed relative to the frame 12. The shafts 35 are connected to a drive (not illustrated) for rotating the shafts 35 and the downstream belts 36 supported by the shafts 35.

The upstream portion 30 of the upper deck 28 comprises a plurality of pulleys that support a plurality of upstream belts 40 arranged transversely across the transfer conveyor 10. Each of the belts 40 is supported by a first pulley 48, a second pulley 50, a third pulley 46, a fourth pulley 44 and a fifth pulley 42. The fourth pulley 44 and the fifth pulley 42 are mounted on shafts 43 that are fixed relative to the frame 12 and which help guide and maintain tension on the belts 40. The first pulley 48, second pulley 50 and third pulley 46 are mounted to a depending wall portion 52 of the carriage 20 and are movable with the carriage 20 relative to the frame 12 (and relative to the fourth and fifth pulleys 44, 42).

The third pulley 46 forms a nose pulley and is the frontmost or upstream-most one of all the pulleys of the upstream portion 30 of the upper deck 28. The first pulley 48 is a nip pulley and is located downward and rearward of the nose pulley 46. The second pulley 50 forms the rearmost pulley of all the pulleys of the upstream portion 30. The portion of the belt 40 that extends from the first pulley 48 to the second pulley 50 lies in a second plane that is parallel to the first plane and that defines an upper boundary of the sheet transport path. The drive (not illustrated) is also operatively connected to the fourth pulley 44 and/or the fifth pulley 42 to rotate the upstream belts 40.

Figure 2:
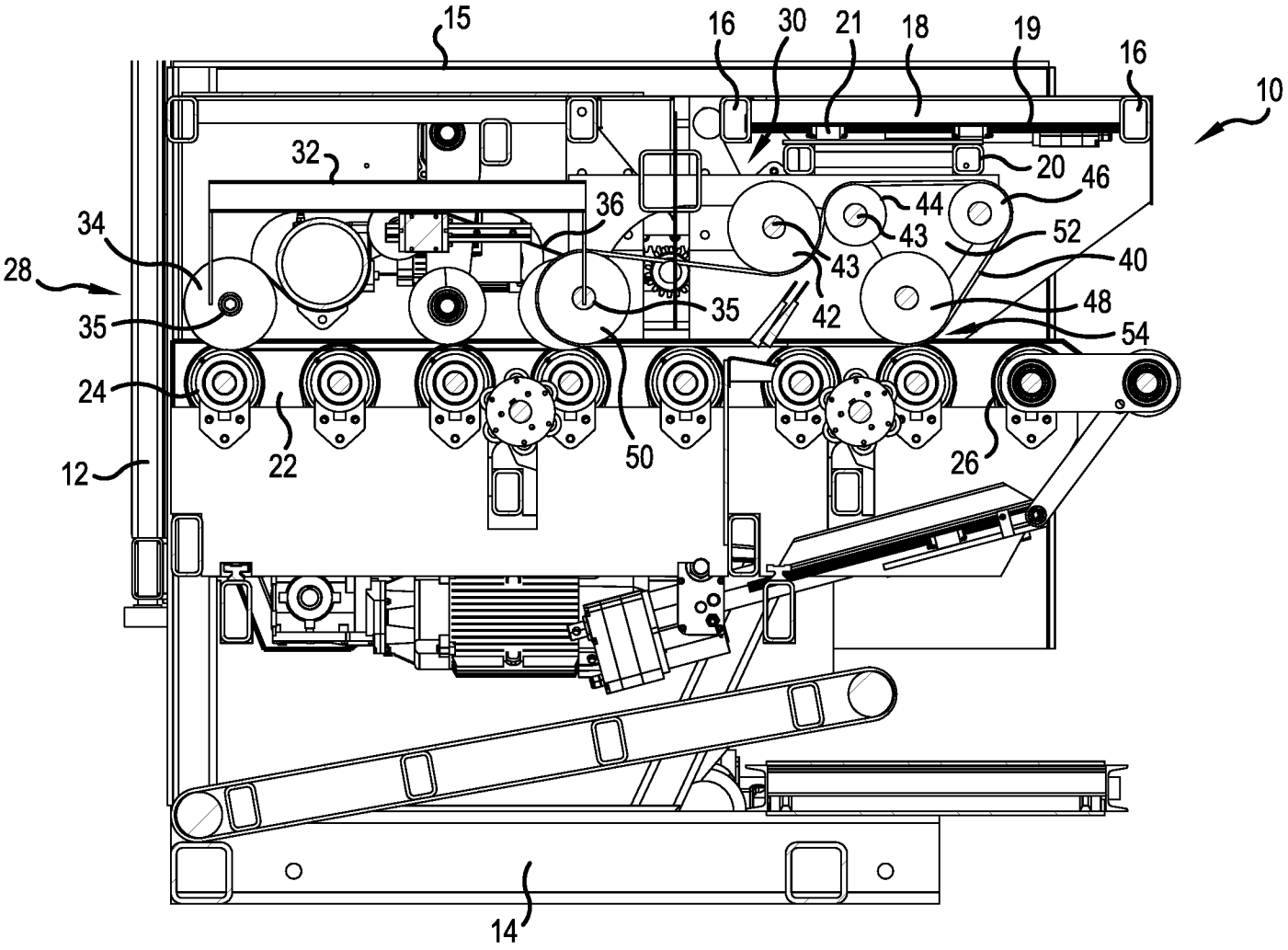
FIG. 2 is a sectional side elevational view of the transfer conveyor of FIG. 1 with the carriage located at a second, rear, location.

FIG. 1 shows the carriage 20 located in a forward position. In this position, the nip 54 formed by the nip wheel 48 and the portion of the belt 40 passing around the first pulley 48 is located at a first or forward position. The term "nip" as used herein indicates the location where an incoming sheet of material is first engaged by the upper belts 40 and the nip wheels 48 even if the nip wheels 48 and the belts 40 are offset from each other in the transverse direction (the direction perpendicular to the direction sheets move through the transfer conveyor). FIG. 2 shows the carriage 20 located at a rear position and the nip 54 located in a second or rear portion ("rear" relative to the forward position of the nip 54 in FIG. 1).

Figure 3:
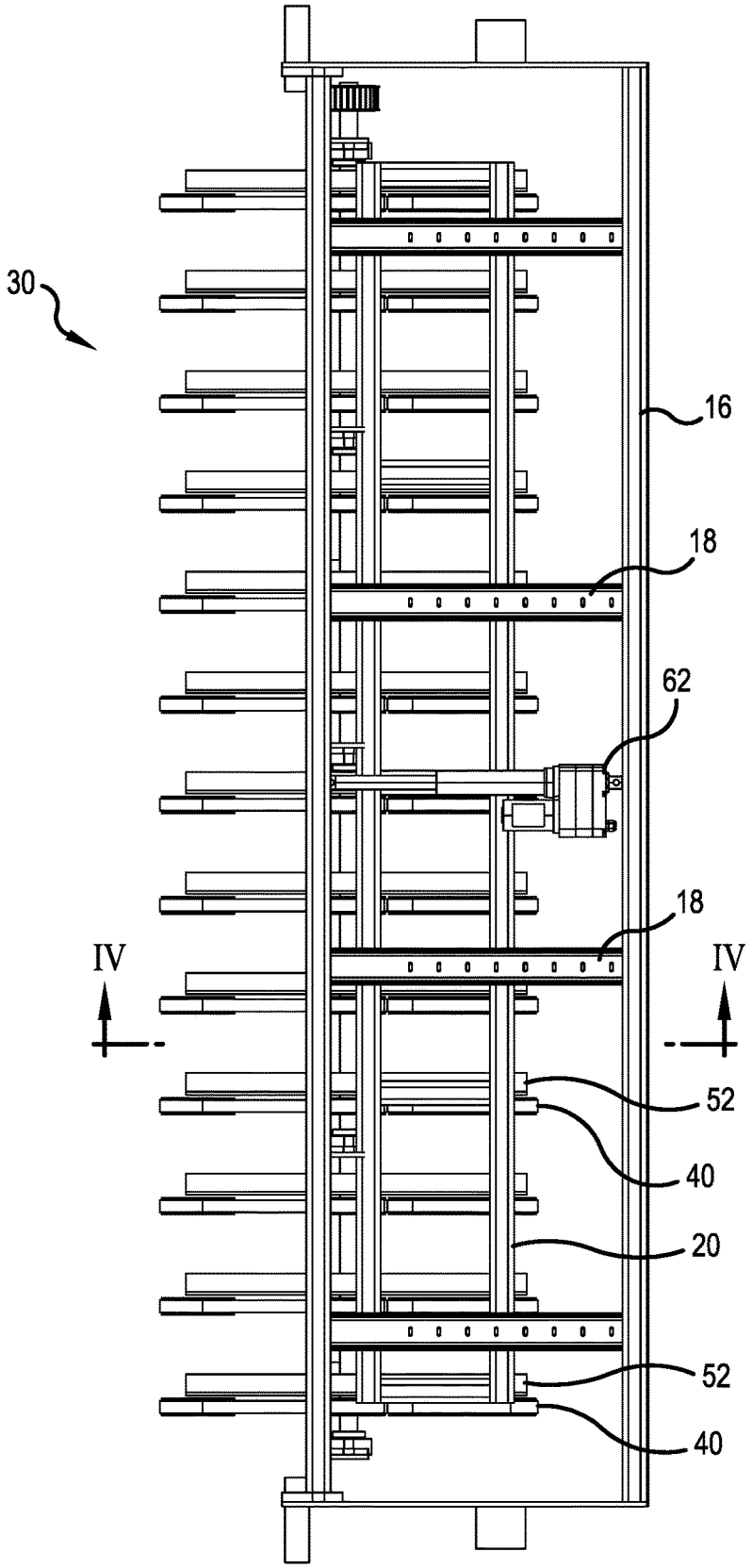
FIG. 3 is a top plan view of the upstream portion of an upper conveyor deck of the conveyor of FIG. 1 located in the rear position.
Figure 4:
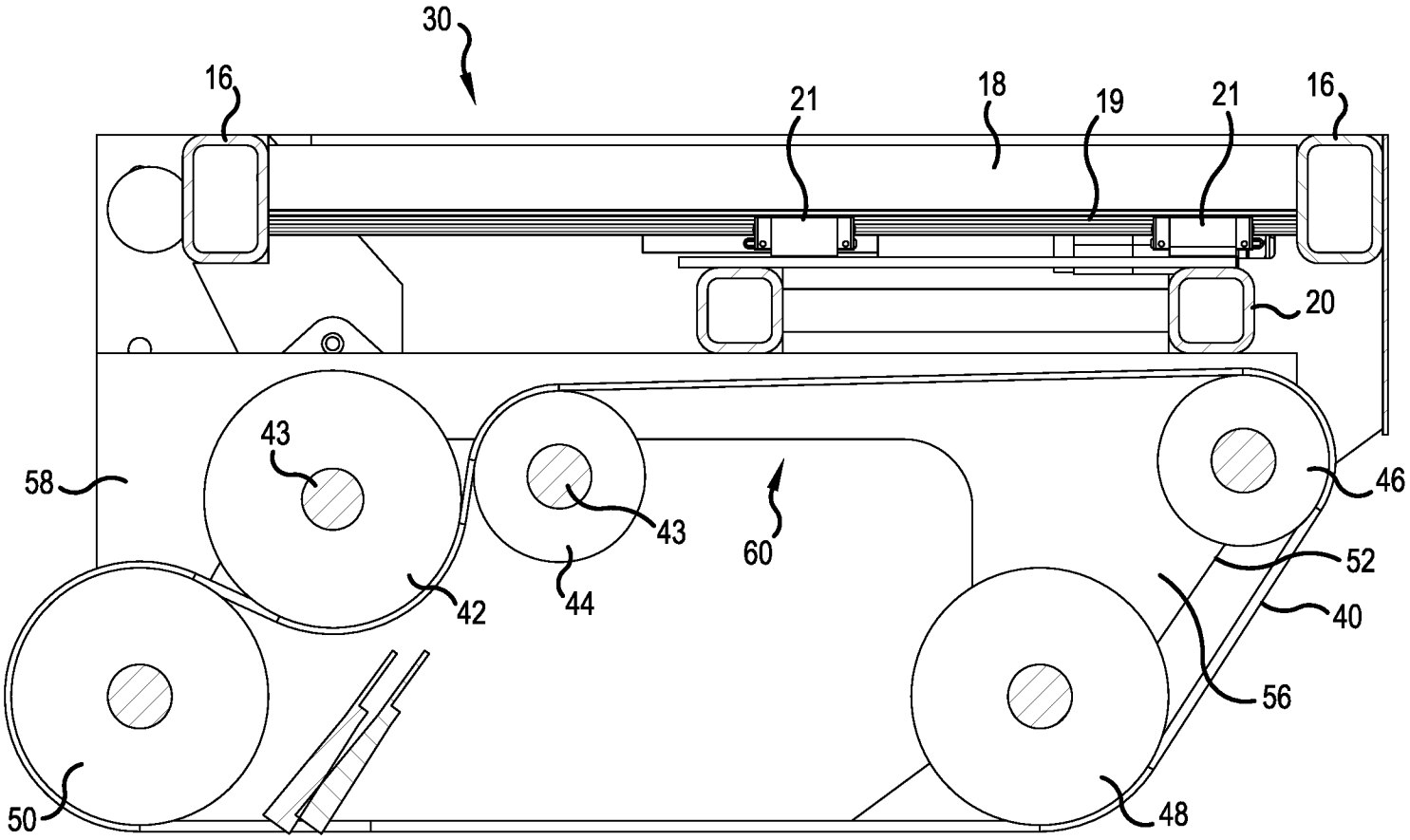
FIG. 4 is a sectional elevational view taken in the direction of line IV-IV in FIG. 3.
Figure 5:
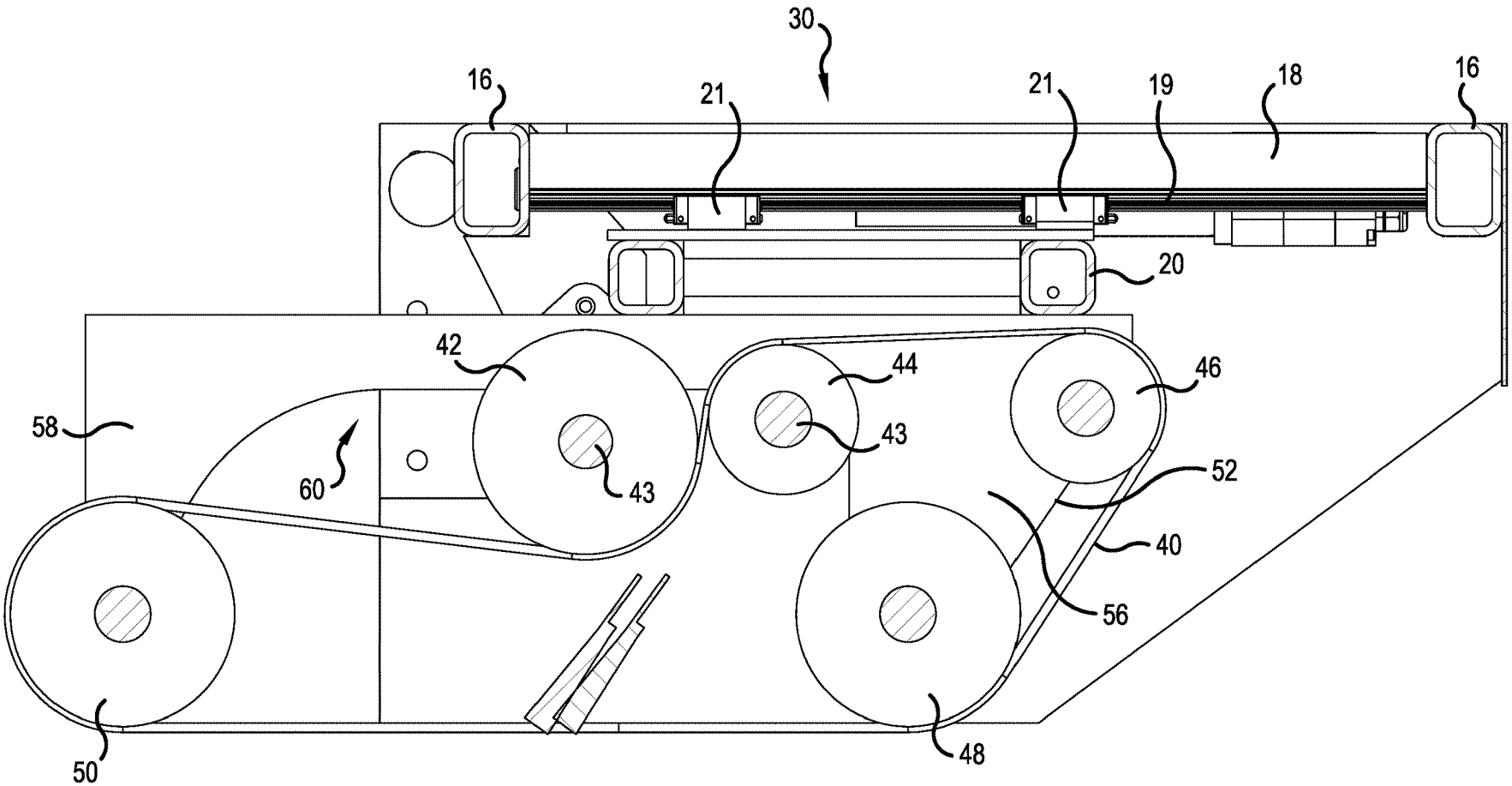
FIG. 5 is a sectional elevation view similar to FIG. 4 but showing the carriage in the forward location.

FIG. 3 is a top view of the upstream portion 30 of the upper deck 28 in the rear position, and FIGS. 4 and 5 are side views of the upstream portion 30 of the upper deck 28 with the carriage 20 in the rear position (FIG. 4) and the forward position (FIG. 5). The depending wall portion 52 of the carriage 20 includes a front leg 56, a rear leg 58 and a concave central portion 60 (a gap) between the front leg 56 and the rear leg 58. The shafts 43 that support the fourth pulley 42 and the fifth pulley 44 pass through the central concave portion 60 but are not attached to the carriage 20. Instead, the concave central portion 60 allows the fourth and fifth pulleys 42, 44 to be aligned with the first, second and third pulleys 48, 50 and 46 which are supported by and movable with the carriage 20 so that the upper belts 40 can rotate with the rotating first through fifth pulleys when the carriage 20 is in the front or rear position or any position between the front and rear positions.

From FIGS. 4 and 5, it can be seen that the relationship of the third pulley 46 and the nip pulley 48 is fixed: these pulleys move together with the carriage 20 and rotate but do not move linearly relative to each other. As the carriage 20 moves from the forward position to the rear position, the nip 54 also moves backward relative to the frame 12 and hence relative to another machine, such as a rotary die cut machine (not illustrated), located upstream from the nip 54. This movement of the nip 54 allows the distance between an exit nip of a rotary die cut machine and the input nip 54 of the transfer conveyor 10 to be adjust based on the length of the sheets being transported.

Figure 6:
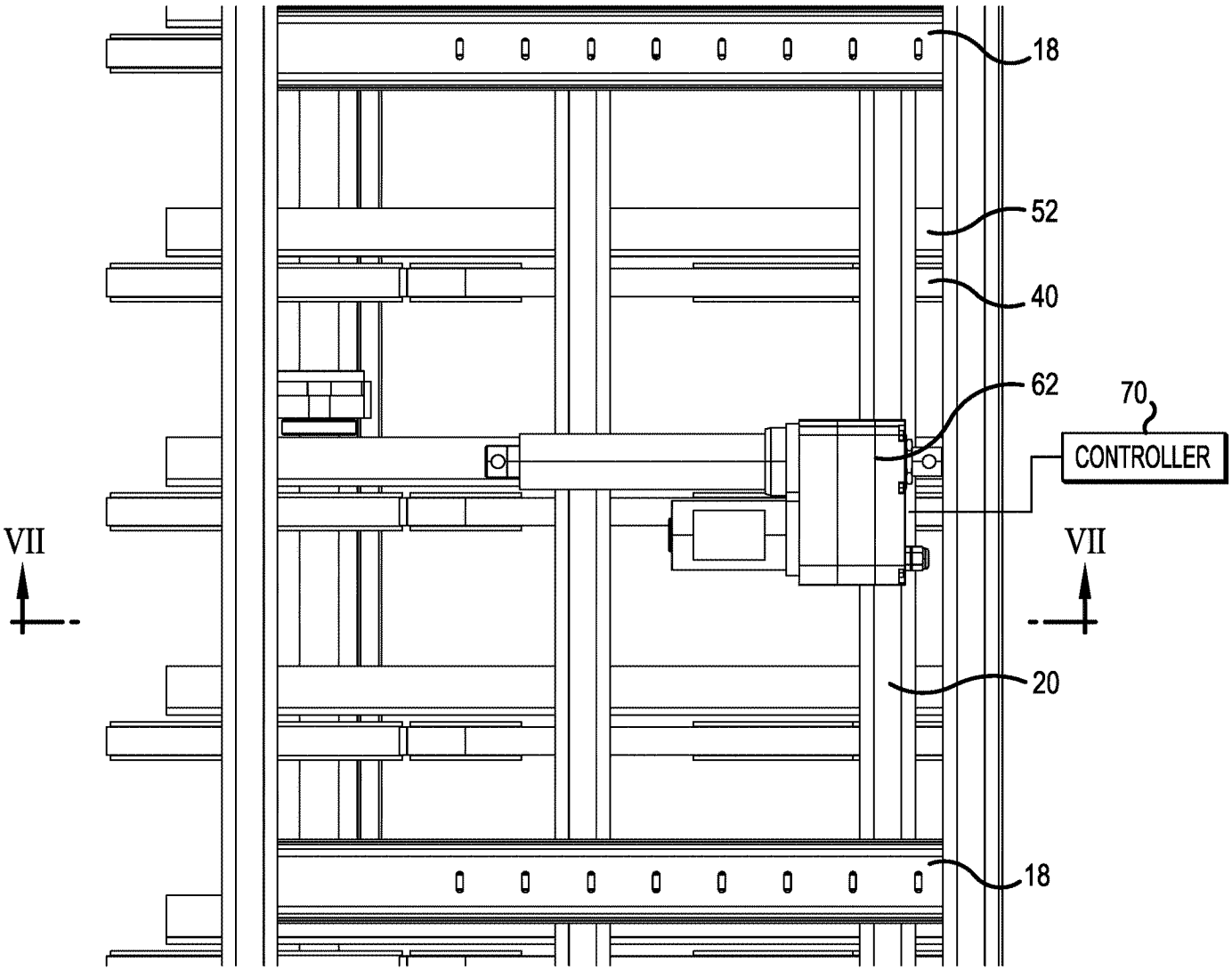
FIG. 6 is a detail view of a central portion of the upper front portion of the transfer conveyor shown in FIG. 3 with the carriage in the forward location.
Figure 7:
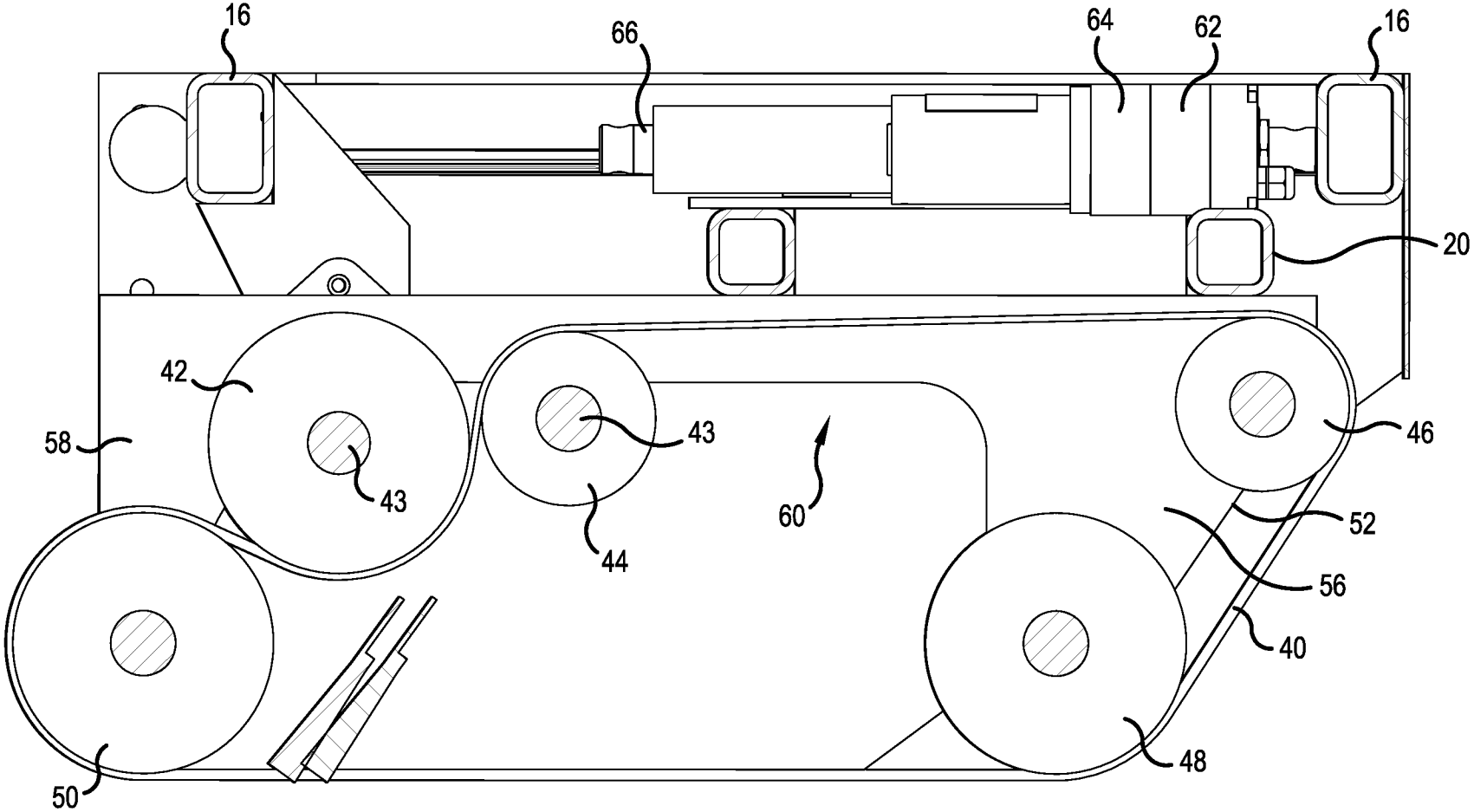
FIG. 7 is a sectional elevational view in the direction of line VII-VII in FIG. 6.
Figure 8:
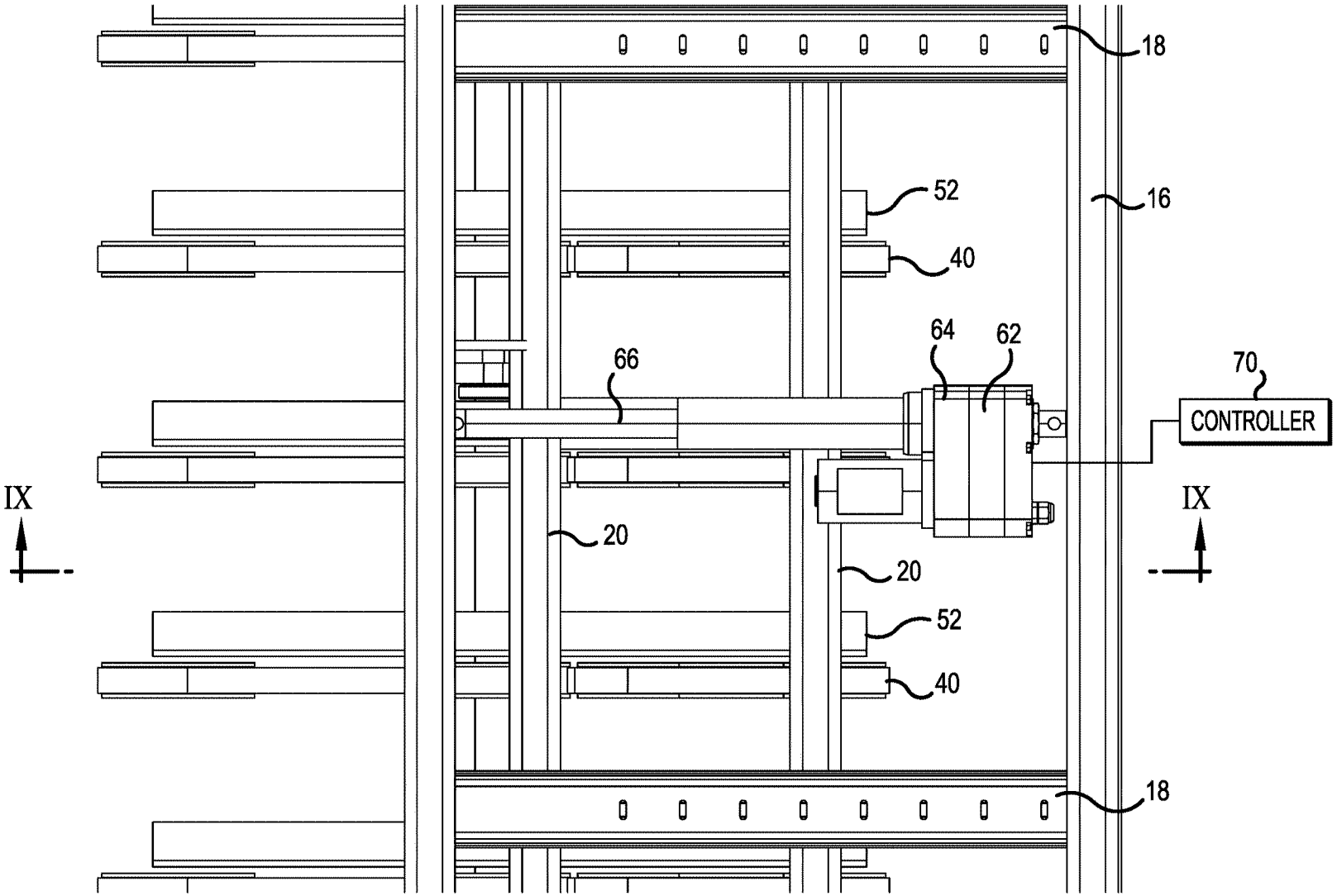
FIG. 8 is a detail view of a central portion of the upper front portion of the transfer conveyor shown in FIG. 3 with the carriage in the rear location.
Figure 9:
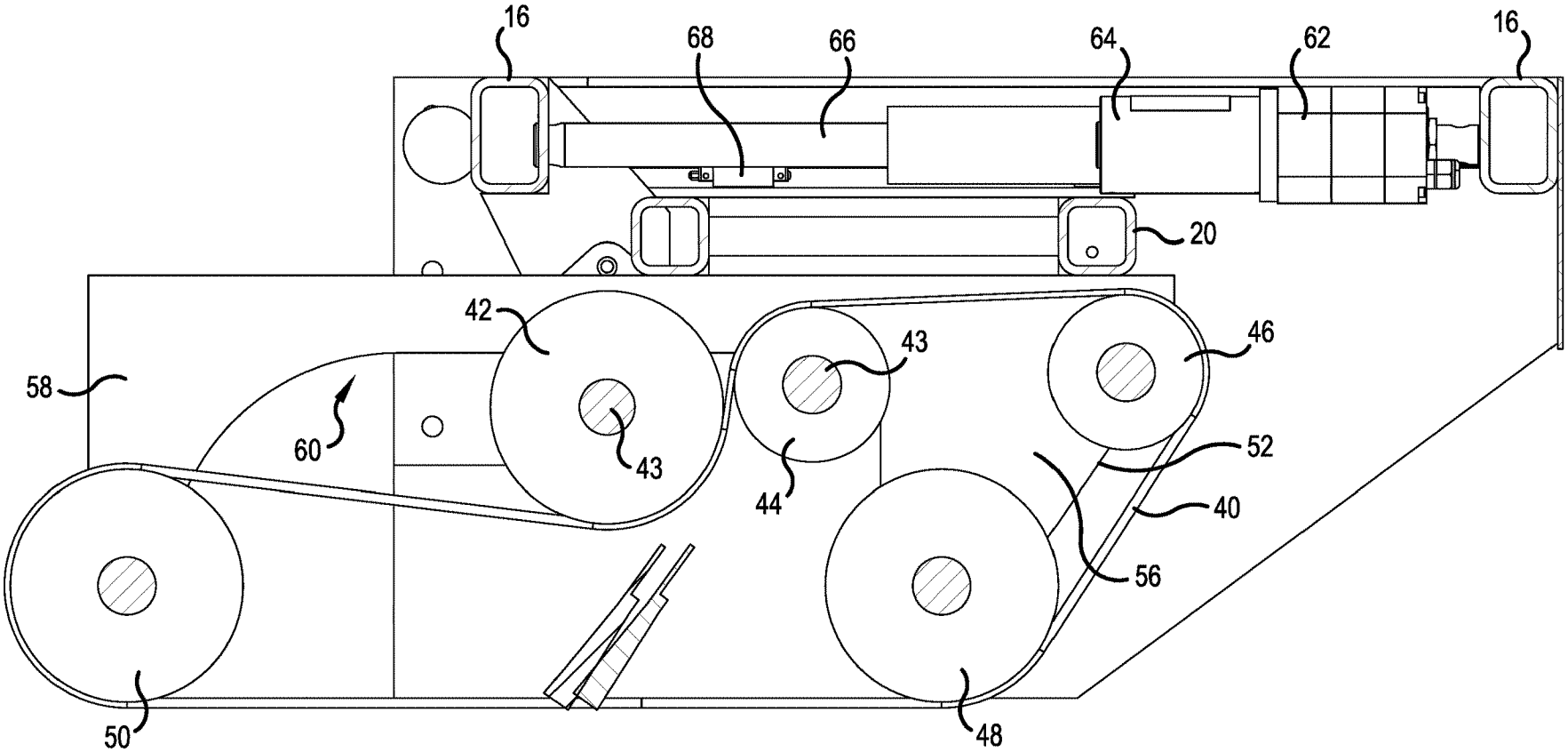
FIG. 9 is a sectional elevational view in the direction of line IX-IX in FIG. 8.

An actuator 62 for shifting the carriage 20 from the front position to the rear position is illustrated from above in FIGS. 6 and 8 and from the side in FIGS. 7 and 9. The actuator 62, which may, for example, comprise a linear actuator, a ball-screw actuator or a hydraulic cylinder, includes a body portion 64 fixed relative to the frame 12 and a movable rod 66 that can be extended and retracted relative to the body portion 64. FIG. 9 shows a bracket 68 by which the movable rod 66 is connected to the carriage 20. Extending and retracting the movable rod 66 moves the carriage 20 along the rails 18 and moves the nip 54 between the forward and rear positions. In the alternative, the actuator 62 may be omitted and the carriage 20 can be moved by hand.

In use, a controller 70, which is connected via wires or wirelessly to the actuator 62, controls the actuator 62 to move the movable rod 66 and thus the carriage 20 and the nip 54 to a desired location to establish a required gap between an upstream piece of equipment and the transfer conveyor 10.

The present invention has been described above in terms of presently preferred embodiments. Modifications and additions to these embodiments will become apparent to persons of ordinary skill in the art upon a reading of the foregoing description, and it is intended that all such modifications form a part of the present disclosure to the extent they fall within the scope of the several claims appended hereto.

What is claimed is:

1. A conveyor configured to transport sheets in a longitudinal direction along a transport path from an input end to a discharge end, the conveyor comprising:

a frame;

a carriage supported by the frame for sliding movement in the longitudinal direction;

a lower conveyor deck supported by the frame, the lower conveyor deck comprising a plurality of contact elements, each contact element of the plurality of contact elements having a contact surface movable around a first closed path from a first contact region to a first non-contact region, the first contact regions lying in a first plane or being bounded by the first plane; and an upper deck including a rear portion comprising a plurality of longitudinally extending transversely spaced first belts each supported by a plurality of first pulleys and a front portion comprising a plurality of longitudinally extending transversely spaced second belts each supported by a plurality of second pulleys;

wherein a subset of the plurality of second pulleys supporting a given one of the second belts includes a first second pulley, a second second pulley, a third second pulley and a fourth second pulley, and wherein the first, second and third second pulleys are supported by the carriage for movement with the carriage relative to the frame, and wherein the fourth second pulley is mounted to a first shaft that is fixed relative to the frame.

2. The conveyor according to claim 1, wherein the subset of the plurality of second pulleys includes a fifth second pulley mounted to a second shaft that is fixed relative to the frame.

3. The conveyor according to claim 1,
wherein the frame includes a plurality of longitudinally extending rails, and
wherein the carriage is slidably supported by the plurality of longitudinally extending rails.

4. The conveyor according to claim 1,
wherein the plurality of contact elements comprise wheels.

5. The conveyor according to claim 4,
including an actuator operably connected to the carriage and configured to move the carriage relative to the frame.

6. The conveyor according to claim 1,
wherein the given one of the second belts defines a closed loop, and
wherein the fourth second pulley is located inside the closed loop.

7. The conveyor according to claim 6,
wherein the subset of the plurality of second pulleys includes a fifth second pulley mounted to a second shaft that is fixed relative to the frame, and
wherein the fifth second pulley is located outside the closed loop.

8. The conveyor according to claim 1,
wherein the third second pulley is the most upstream second pulley of the plurality of second pulleys,
wherein the first second pulley is the second-most upstream second pulley of the plurality of second pulleys,
wherein a portion of the belt extending from the first second pulley to the second second pulley lies in a second plane parallel to the first plane, and
wherein the first plane defines a lower boundary of the transport path and the second plane defines an upper boundary of the transport path.

9. The conveyor according to claim 1,
including a support wall depending from the carriage, the support wall having a first leg, a second leg and a gap between the first leg and the second leg,
wherein the first second pulley is supported by the first leg,
wherein the second second pulley is supported by the second leg, and
wherein the first shaft extends into the gap.

10. The conveyor according to claim 9,
wherein the subset of the plurality of second pulleys includes a fifth second pulley mounted to a second shaft that is fixed relative to the frame, and
wherein the second shaft extends into the gap.

11. The conveyor according to claim 1,
including:
an actuator operably connected to the carriage and configured to move the carriage relative to the frame, and
a support wall depending from the carriage, the support wall having a first leg, a second leg and a gap between the first leg and the second leg,
wherein:
the plurality of contact elements comprise wheels,
the frame includes a plurality of longitudinally extending rails and the carriage is slidably supported by the plurality of longitudinally extending rails,
the subset of the plurality of second pulleys includes a fifth second pulley mounted to a second shaft that is fixed relative to the frame, the first shaft and the second shaft extending into the gap,
the first second pulley is supported by the first leg and the second second pulley is supported by the second leg,
each of the plurality of second belts defines a closed loop and the fourth second pulley is located inside the closed loop and the fifth second pulley is located outside the closed loop,
a portion of the belt extending from the first second pulley to the second second pulley lies in a second plane parallel to the first plane, and
the first plane defines a lower boundary of the transport path and the second plane defines an upper boundary of the transport path.

12. A conveyor configured to transport sheets in a longitudinal direction along a transport path from an input end to a discharge end, the conveyor comprising:
a frame;
a carriage supported by the frame for sliding movement in the longitudinal direction;
a lower conveyor deck supported by the frame, the lower conveyor deck comprising a plurality of contact elements, each contact element of the plurality of contact elements having a contact surface movable around a first closed path from a first contact region to a first non-contact region, the first contact regions lying in a first plane or being bounded by the first plane; and
an upper deck including a rear portion comprising a plurality of longitudinally extending transversely spaced first belts each supported by a plurality of first pulleys and a front portion comprising a plurality of longitudinally extending transversely spaced second belts each supported by a plurality of second pulleys;
wherein a subset of the plurality of second pulleys supporting a given one of the second belts includes a first second pulley and a second second pulley,
wherein the first second pulley and the second second pulley are supported by the carriage for movement with the carriage relative to the frame,
wherein the given one of the second belts defines a closed loop, and
wherein the first second pulley and the second second pulley are located inside the closed loop, and
wherein a third second pulley is mounted to a first shaft that is fixed relative to the frame.

13. The conveyor according to claim 12,
including a support wall depending from the carriage, the support wall having a first leg, a second leg and a gap between the first leg and the second leg,
wherein the first second pulley is supported by the first leg,
wherein the second second pulley is supported by the second leg, and
wherein the first shaft extends into the gap.

14. The conveyor according to claim 13,
wherein the third second pulley is located inside the loop.

15. The conveyor according to claim 12,
wherein a fourth second pulley is supported by the carriage and located inside the closed loop.

16. A conveyor configured to transport sheets in a longitudinal direction along a transport path from an input end to a discharge end, the conveyor comprising:
a frame;
a carriage supported by the frame for sliding movement in the longitudinal direction;
a support wall depending from the carriage, the support wall having a first leg, a second leg and a gap between the first leg and the second leg,
a lower conveyor deck supported by the frame, the lower conveyor deck comprising a plurality of contact elements, each contact element of the plurality of contact elements having a contact surface movable around a first closed path from a first contact region to a first non-contact region, the first contact regions lying in a first plane or being bounded by the first plane; and an upper deck including a rear portion comprising a plurality of longitudinally extending transversely spaced first belts each supported by a plurality of first pulleys and a front portion comprising a plurality of longitudinally extending transversely spaced second belts each supported by a plurality of second pulleys;

wherein the plurality of second pulleys supporting a given one of the second belts includes a first second pulley and a second second pulley, wherein the first second pulley is supported by the first leg, wherein the second second pulley is supported by the second leg, and wherein a first shaft fixed relative to the frame extends into the gap and supports a third second pulley.

17. The conveyor according to claim 16, including a fourth second pulley supported by the support wall, wherein the given one of the second belts defines a closed loop, wherein the first second pulley, second second pulley and fourth second pulley are located inside the closed loop, and wherein the third second pulley is located outside the closed loop.

18. The conveyor according to claim 17, including a second shaft fixed relative to the frame and extending into the gap, and a fifth second pulley mounted on the second shaft and located inside the closed loop.

* * * * *